US006708548B2

(12) United States Patent
Ehrke et al.

(10) Patent No.: US 6,708,548 B2
(45) Date of Patent: Mar. 23, 2004

(54) DEVICE FOR FORMING AN END AREA OF A WORKPIECE

(75) Inventors: Dieter Ehrke, Bielefeld (DE); Udo Hunkenschroeder, Bielefeld (DE); Frank-Stefan Runte, Schloss/Stukenbrock (DE); Martin Ziehl, Hövelhof (DE)

(73) Assignee: Parker-Hannifin GmbH (DE)

( * ) Notice: Subject to any disclaimer, the term of this patent is extended or adjusted under 35 U.S.C. 154(b) by 0 days.

(21) Appl. No.: 10/240,620

(22) PCT Filed: Aug. 11, 2001

(86) PCT No.: PCT/DE01/03117

§ 371 (c)(1),
(2), (4) Date: Sep. 30, 2002

(87) PCT Pub. No.: WO02/13992

PCT Pub. Date: Feb. 21, 2002

(65) Prior Publication Data

US 2003/0046969 A1 Mar. 13, 2003

(30) Foreign Application Priority Data

Aug. 16, 2000 (DE) ..... 100 40 596
Aug. 16, 2000 (DE) ..... 100 40 595

(51) Int. Cl.[7] ..... B21D 41/00

(52) U.S. Cl. ..... 72/312; 72/316; 72/318; 72/370.1

(58) Field of Search ..... 72/318, 316, 312, 72/313, 314, 315, 370.1, 370.03, 452.9

(56) References Cited

U.S. PATENT DOCUMENTS

| | | | | | |
|---|---|---|---|---|---|
| 2,464,510 | A | * | 3/1949 | Hull | 72/312 |
| 3,393,549 | A | * | 7/1968 | Gregg | 72/312 |
| 3,820,375 | A | * | 6/1974 | Koski | 72/318 |
| 3,838,591 | A | | 10/1974 | Ross | 72/318 |
| 5,709,121 | A | * | 1/1998 | Camping | 72/316 |
| 6,508,097 | B2 | * | 1/2003 | Ose | 72/312 |

FOREIGN PATENT DOCUMENTS

| | | |
|---|---|---|
| DE | 19511447 | 10/1996 |
| DE | 297 20 321 | 3/1998 |

* cited by examiner

*Primary Examiner*—Daniel C. Crane
(74) *Attorney, Agent, or Firm*—R W Becker & Associates; R W Becker

(57) ABSTRACT

The invention relates to a device for forming an end area of a workpiece (2), especially for cold press-forming an end area of a pipe, comprising two force transmitting elements (7, 9) which are guided in a common housing (3). The device is characterised in that a first pressure chamber (26) is located between the two force transmission elements (7, 9) and in that a second pressure chamber (28) is allocated to the second force transmission element (9). When the first force transmission element (7) is in the bracing position, the second force transmission element (9) can be displaced in relation to the first force transmission element (7) in order to form the workpiece.

15 Claims, 6 Drawing Sheets

DEVICE FOR FORMING AN END AREA OF A WORKPIECE

BACKGROUND OF THE INVENTION

The invention relates to a device for shape-forming the end region of a workpiece, especially for cold-press shape-forming of a pipe end region. It is known to set in compression a workpiece by means of a first hydro-dynamically actuable force transmission element and to shape-form the end region via direct or indirect application of force thereagainst by a second hydrodynamically actuable force transmission element. The concept of hydro-dynamically actuable force transmission elements comprehends a body which is actuable in a hydraulic and/or pneumatic manner. In connection with the highest force which is required for the shape-forming of a workpiece, a hydraulic actuation is chosen specifically for this purpose.

DE 195 11 447 A1 discloses a device adapted for shape-forming a pipe end region. This device includes a recess for exchangeable jaws operable to set the pipe in compression. By means of a first hydraulically actuable piston, the jaws are driven under pressure in order to compressively engage the pipe. The first piston comprises a central through opening in which a piston rod of a second hydraulically actuable piston is guidably disposed. The two pistons are in this manner coaxially movable within one and the same housing serially one behind the other.

The piston rod of the second piston, which is provided with a shape-forming tool, can effect application of a force on the pipe end region, in view of the fact that the piston rod extends through the central, end-to-end continuously open, opening in the first piston, whereby the pipe end region is shape-formed in the axial direction. In this manner, the end region deforms in correspondence with the geometry of the shape-forming tool and the jaws.

In a special configuration, the known device comprises a three-part housing. A first housing portion has a first bore in which the first, annularly shaped, piston is movably guided with its sleeve and has a second bore in which the second piston with its piston rod is movably guided. The second bore has a relatively smaller diameter than the first bore. In this manner, a stop or shoulder for engaging the sleeve of the first, annularly shaped, piston is formed which defines the maximum return position of the first piston. A hydraulic fluid can be introduced for actuating the first piston between the stop or shoulder and the piston sleeve. A further portion of the three-piece housing forms with the first housing portion a threadable housing end piece which comprises a cylindrical bore for guiding the end piece of the second piston. The first housing portion forms a stop or shoulder in the actuation direction of the second piston. A hydraulic medium can be introduced between the stop or shoulder and the second piston in order to effect a return movement of the second piston after the shape-forming of the pipe. The corresponding hydraulic space for receipt of the hydraulic fluid is sealed off relative to the first hydraulic space between the sleeve of the first piston and its rearward stop or shoulder. The third portion of the three-piece housing forms the receiving portion for the jaws and the forward portion of the first and the second pistons or, respectively, the shape-forming tool. The shape-forming tool is configured and connected with the forward end region of the piston rod of the second piston such that, during return movement of the second piston, the first piston is correspondingly brought along and the jaws are thus released from their compression position. In this connection, the central through opening of the first piston comprises a rearward stop or shoulder. The shape-forming process performed by the known device disclosed in DE 195 11 447 A1 is, to this extent, burdened with disadvantages in that a control of the course of the shape-forming process from the beginning to the end thereof as well as a monitoring of the tool and the pipe to be shape-formed before the beginning of the shape-forming process is neither provided for nor possible due to the coupling of the two pistons during their return movements.

SUMMARY OF THE INVENTION

The invention provides a solution to the challenge of making available a device for shape-forming a workpiece end region which makes possible a better control of the shape-forming process.

The solution to this challenge is revealed in the advantageous embodiments and further configurations of the invention as set forth in the patent claims which follow this description.

In this connection, the invention initially provides, in a first embodiment, that, between the first force transmission element and the second force transmission element, a first pressure space is arranged communicated with a first pressure connector and that the second force transmission element has a second pressure space, communicated with a pressure connector, arranged relative thereto such that the introduction of a pressure medium into the second pressure space drives the second force transmission element in the compression and shape-forming direction. During the forward displacement of the second force transmission element to set the workpiece in compression, the pressure exerted by the pressure medium in the first pressure space is maintained via blockage of the first pressure connector, whereby, upon reaching a predetermined overpressure, the pressure medium is released from the first pressure space, so that the second force transmission element moves relative to the first force transmission element, which remains in its workpiece compressive engagement position, to thereby effect shape-forming of the workpiece and, after the shape-forming of the end region of the workpiece, the second force transmission element is moved rearwardly to its start position by a renewed introduction of a pressure medium in the first pressure space and, by means of a special drive, the first force transmission element is moved correspondingly therewith back into its start position.

In this connection, the advantage is provided that, by reason of the pressure controlled release of the pressure medium in the first pressure space following the reaching of the overpressure during the forward displacement of the second force transmission element, the workpiece compressive engagement pressure is uniformly maintained at the required value. The required pressure need only be maintained so long as is necessary. In this manner, an unnecessarily high pressure, and an unnecessarily long time period for the maintained pressure and the therewith connected unnecessary loss of performance and high temperature development, are avoided in an advantageous manner. After completion of the shape-forming process, the second force transmission element is movable in an active manner back into its start position.

In accordance with one embodiment of the invention, it is provided that a third pressure space with a connection to a third pressure connector is provided as a drive for the return movement of the first force transmission element. Alternatively, the drive for the return movement of the first force transmission element can, however, be additionally configured as a return spring.

In accordance with an embodiment of the invention, it is provided that the start position of the first force transmission element is defined between the housing and a first force transmission element stop or shoulder. By fixedly positioning the first force transmission element in its start position as well as, also, by selection of the start position of the second force transmission element, the relative displacement movement path between the second and the first force transmission elements required for the shape-forming process is constructively laid out.

In accordance with embodiments of the invention, sensors are provided which recognize the inserted workpiece as well as monitor the respective position of the first force transmission element to determine whether the first force transmission element has again been returned into its start position. In this connection, it is provided, in a case-by-case manner, that before the start of the shape-forming process, it can be automatically determined whether a suitable compression and/or shape-forming tool is available and/or is properly positioned, whereby the availability and/or the proper position of the shape-forming tool can be determined by a non-contact distance measurement effected by a sensor. Additionally, it can be provided that, via a sensor, the start position of the shape-forming tool and the position thereof during the shape-forming process can be sensed.

In a further development of the inventive device, it can be provided that the required relative movement path for the shape-forming process between the first force transmission element and the second force transmission element—that is, the so-called shape-form length L—is adjustably settable in a first process step, such that the first force transmission element is movable away from the second force transmission element by introduction of a pressure medium into the first pressure space, whereby, via introduction of a pressure medium in the second pressure space, the compression process and the shape-forming process follow thereafter as described. A pressure medium is, accordingly, introduced into the first pressure space both for actuation of the first force transmission element as well as for releasing the second force transmission element, whereby there is obtained the advantage of a still further improved control possibility for the shape-forming process.

In this connection, it can be provided that the length of the first pressure space between the first actuation surface and the second actuation surface is adjustably set before the shape-forming of the workpiece in order to set the desired defined work path. Following therefrom, the two force transmission elements can be moved while maintaining a constant relative position to one another until the workpiece has been set in compression. As a further consequence thereof, the second force transmission element is movable precisely along the predetermined length of the pressure space against the first force transmission element, so that the compressively engaged workpiece is shape-formed by a movement along this length. The shape-forming process is brought to an end in particular due to the engagement of the first actuation surface and the second actuation surface of the first pressure space with one another.

In a further configuration of the device, the length of the pressure space is directly or indirectly measurable in order to adjustably set the length. In particular, the length is indirectly measurable via a distance sensor which is oriented toward a surface whose distance from the distance sensor varies as a function of the length of the pressure space. A surface of this type is, for example, configured as an outwardly expanding conical outer surface of the first force transmission element. It is advantageous if a non-contact measuring distance sensor is deployed.

A non-contact measuring sensor is provided which emits a signal in dependence upon whether the workpiece to be shape-formed is in a start position in which it can be compressively engaged and/or shape-formed. The sensor is, in particular, a distance sensor which measures the distance in a measurement direction to the most closely adjacent object. Such sensors, including, for example, a laser emitting sensor, are known.

In this event, the workpiece need only be disposed in the start position in order to produce the signal. In particular for controlling the compression process and/or the shape-forming process, a control is provided which is connected via a signal connection with the sensor. By means of the transmission of a signal to the control, especially, an automatic signal, the compression process and/or shape-forming process is initiated.

In particular, non-contact measurement of a dimension of the workpiece to be shape-formed or, respectively, a measurement value, is performed which provides a clear measurement of the dimension of the workpiece to be shape-formed. If, for example, a pipe is to be shape-formed, the possibility is available to measure the pipe diameter. This permits, before the start of the compression process and/or the shape-forming process, a monitoring of whether a workpiece with the desired dimensions for shape-forming is standing ready. If the proper workpiece has not been brought into a start position or there is, in any event, no workpiece at all in the start position, a start signal is correspondingly also not produced. An unintended actuation of the shape-forming device or, respectively, the working of the workpiece with false dimensions can thus be avoided in this manner. An important advantage lies in the fact that security measures for protecting the operating personnel can be maintained in a simple manner and, at the same time, damage of the device such as through the disposition of too large a workpiece therein, can be prevented.

Furthermore, it is suggested that, before the start of the compression process and/or the shape-forming process, that it be automatically determined whether a suitable compression and/or shape-forming tool is available and/or is properly positioned. In this connection, it is particularly suggested to provide a non-contact measuring sensor which generates a signal as a function of whether a suitable compression and/or shape-forming tool is available and/or is properly positioned. A shape-forming tool recognition in this manner can be combined with the above-described sensor to produce a start signal in order to achieve still greater assurance against false actuation and false functioning. In particular, the same sensor can be used for measuring the start position and for measuring the availability and/or the positioning of the shape-forming tool. In this event, the availability and/or the proper positioning of the shape-forming tool is, preferably, initially measured or, respectively, pre-set.

Moreover, it is further suggested to provide a sensor which measures in a non-contact manner the progression or continuing movement of the shape-forming of the workpiece. In particular, a control can be further provided which receives a signal of the sensor, and which, after the shape-forming has been adequately performed, effects the end of the shape-forming process.

BRIEF DESCRIPTION OF THE DRAWINGS

The inventive device is described hereinafter in connection with two embodiments thereof; in this regard, the drawings show.

DESCRIPTION OF PREFERRED EMBODIMENTS

Figure 1:
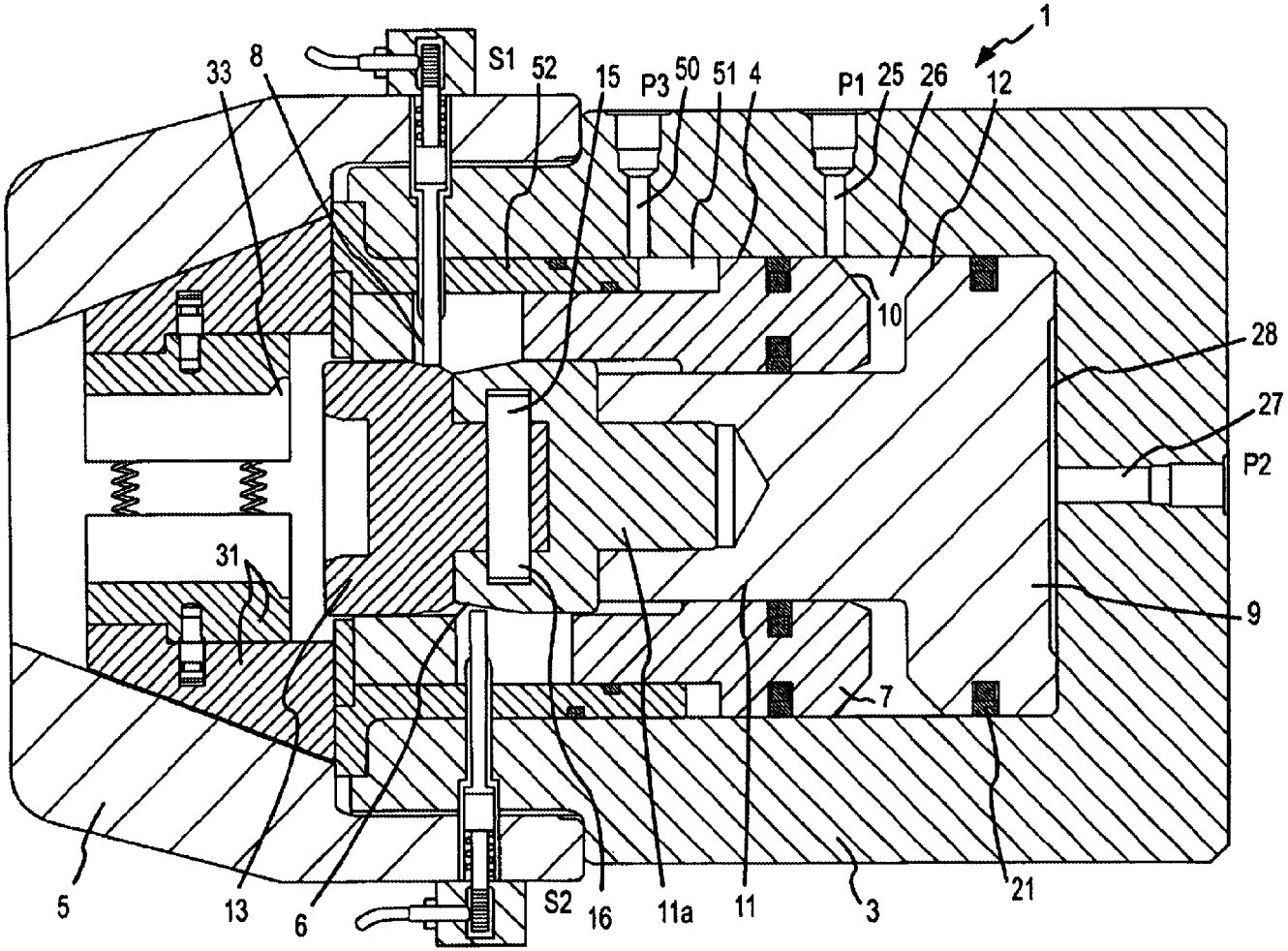
FIG. 1 A longitudinal view through a shape-forming device in its start position, FIG. 2 the shape-forming device shown in FIG. 1 having a workpiece received therein in the start position, FIG. 3 the shape-forming device after the completion of the workpiece compressive engagement process, FIG. 4 the shape-forming device in its position at the end of the shape-forming process, FIG. 5 the shape-forming device in the intermediate position during return movement at a time at which the second force transmitting element has already been returned to its start position, FIG. 6 the shape-forming device in another embodiment thereof comprising a function for variable adjustment of the shape-form length (L), the shape-forming device being shown in the start position, FIG. 7 the subject matter shown in FIG. 6 with an inserted pipe end, FIG. 8 the shape-forming device as shown in FIG. 6 following setting of the shape-form length (L), FIG. 9 the shape-forming device as shown in FIG. 8 upon reaching the workpiece compressive engagement position of the first force transmitting element, FIG. 10 the shape-forming device as shown in FIG. 9 following completion of the shape-forming process.

FIG. 1 shows a longitudinal view through a shape-forming device 1. The shape-forming device 1 includes a base housing 3 having a central cylindrical bore such that a cylinder surface 4 is formed thereby. In the region of the open end of the base housing 3, a receiving housing 5 is disposed for receipt of jaws 31 operable as compression jaws. The cylinder surface 4 is configured as a guide surface for guiding the movement of a first force transmission element configured as an outer ring piston 7 and for guiding the movement of a second force transmission element configured as an inner piston 9. The inner piston 9 substantially completely fills the closed end of the cylindrical bore. A piston rod 11 of the inner piston 9 extends in the direction toward the open end of the cylinder bore. The piston rod 11 is received in a central cylindrical bore of the outer piston 7 and is fixedly coupled with an extension piece 11(*a*) which is, in turn, connected to a compression tool 13. The outer piston 7 thus forms a guide for guiding the movement of both the piston rod 11 and a rotation preventing device 15 which connects the piston rod 11 or its extension piece 11(*a*) with a compression tool 13 operable as a shape-forming tool.

The rotation preventing device 15 is operable in a manner similar to a bayonet lock. A locking projection 16 of the compression tool 13 is disposed, via a linear movement in the axial direction of the extension piece 11(*a*) of the piston rod 11, into a corresponding recess in the extension piece 11(*a*) and is thereafter pivoted about the longitudinal axis of the piston rod 11 in order to lock the connection.

The base housing 3 comprises a first pressure connection 25 through which a hydraulic medium can be introduced into the interior of the base housing 3 or, respectively, can be discharged from the base housing 3. A first pressure space 26 in the base housing 3 is communicated with the first pressure connector 25, the pressure space being disposed outside of the cylinder surface 4 and being limited, as well, by a first actuation surface 10 of the outer piston 7 and by a second actuation surface 12 of the inner piston 9. The first pressure space 26 is configured as a relatively larger or smaller space as a function of the operational condition of the shape-forming device 1 and can be disposed in various positions relative to the first pressure connector 25 (see FIGS. 1–5). In each operational condition, however, the first pressure connector 25 is communicated with the first pressure space 26.

In particular, the first pressure space 26 expands outwardly in the radial direction, as the first actuation surface 10 and the second actuation surface 12 are each partially configured as conical surfaces.

Figure 3:
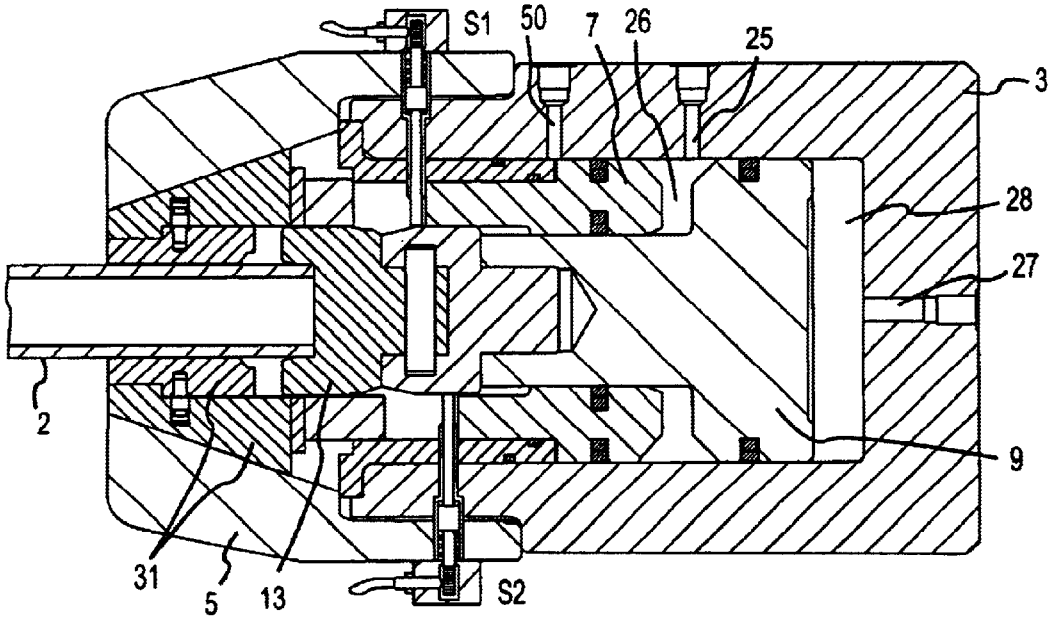
Figure 4:
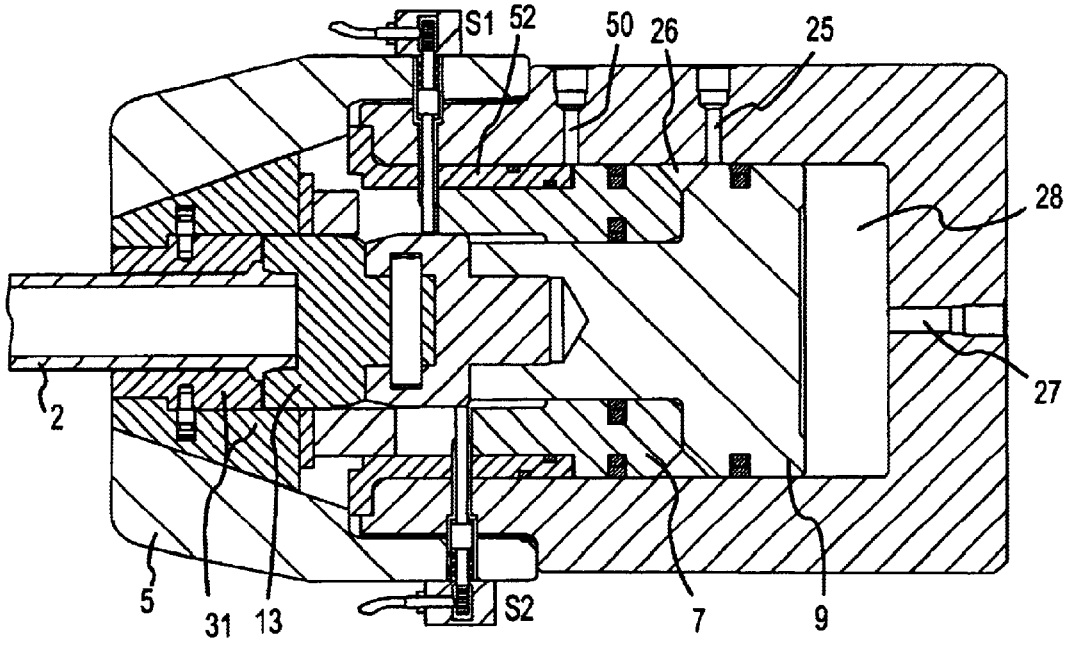

As can be seen in FIGS. 3 and 4, the first actuation surface 10 and the second actuation surface 12 each respectively comprise a further region which is annularly shaped and represents a stop or shoulder for the other piston 7, 9.

The first pressure space 26 is sealed off against the open end and the closed end of the cylinder bore of the base housing 3 by seals between the piston rod 11 and the inner surface of the outer piston 7, by seals between the outer surface of the outer piston 7 and the cylinder surface 4, and as well by seals between the outer surface of the inner piston 9 and the cylinder surface 4. The seals are collectively designated with the reference numeral 21.

In the region of the closed end of the cylinder bore, there is additionally provided a second pressure space 28 in the base housing 3 which is communicated with a second pressure connector 27. The second pressure space 28 has a variable volume which can be varied to a value of practically zero.

On the side of the outer piston 7 turned away from the first pressure space 26, a third pressure space 51 is formed in the compression and shape-forming device in front of the outer piston 7 between this piston and a housing insert 52, the third pressure space being communicated with a third pressure connector 50. This third pressure space 51 serves as a drive for the return movement of the outer piston 7 into its start position.

The receiving housing 5 forms a receiving space for the jaws 31 which are operable through actuation of the pistons 7,9—that is, through the movement of the pistons in the axial direction—to place a workpiece under compression. The jaws 31 are, for example, configured and actuated in the same manner as the jaws shown in DE 195 11 447 A1.

The jaws 31 include, on the right hand back end thereof as viewed in FIGS. 1–5, a shape-forming recess 33 which forms an encircling groove-type recess closing upon itself if a workpiece with a corresponding outer dimension is disposed under compression in the shape-forming device. The shape-forming recess 33 serves to shape-form the workpiece as will be described hereinafter in more detail. Alternatively or additionally, the shape-forming can also be effected by selection of the geometry of an alternative compression tool which is provided in lieu of the illustrated compression tool 13 and which is connectable with the piston rod 11.

The compression tool 13 comprises, on its free back end at which the compression tool has a smaller outer diameter than the area thereof axially behind this free back end, a measurement band 8.

The inner piston 9 comprises, in the region of the free end of its piston rod 11 or its respective extension piece 11(*a*) which extends toward the jaws 31, a conically shaped section 6 which forms the outer periphery of the extension piece 11(*a*).

Two bores are formed in the complete housing formed by the base housing 3 and the receiving housing 5, the two bores extending in a radial direction to the central longitudinal axis of the shape-forming device 1. A sensor S1 or, respectively, S2, is arranged in each respective bore. The sensor S1 serves to identify the compression tool 13 in that the sensor S1 is oriented toward the measurement band 8 of the compression tool 13 and can identify the respective compression tool 13 as a function of the distance between the sensor S1 and the measurement band 8.

The sensor S2 serves to establish the base position of the inner piston 9 in that the sensor S2 is oriented toward the conical surface 6 of the extension piece 11(*a*) that is connected with the inner piston 9, so that, via the determination of the position of the conical surface 6 or, respectively, the movement of the extension piece 11(*a*) with the cylindrical peripheral surface relative to the sensor S2, the continuation of the movement of the inner piston 9 is sensed.

Figure 2:
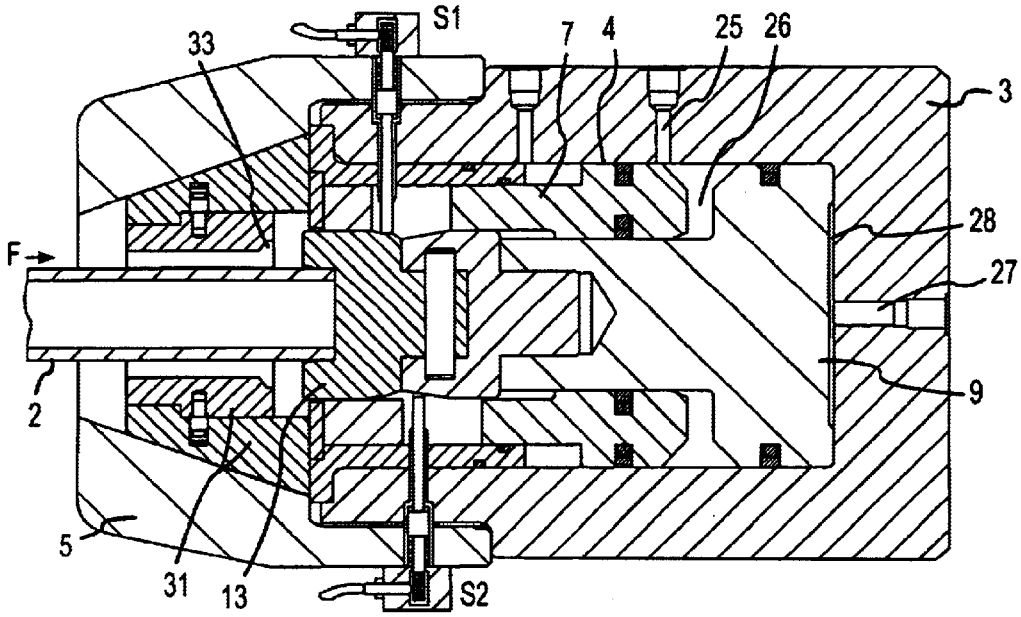

An example of the operation of the shape-forming device 1 is hereinafter described:

Starting from the position of the shape-forming device as shown in FIG. 1, initially, a workpiece such as, in particular, the end of a pipe 2, is introduced into the shape-forming device until the inward end of the pipe is seated against the compression tool 13, whereby the start position of the shape-forming device can be seen in FIG. 2. As can be seen in FIG. 3, the pressure space 28 is filled with a pressurized medium which leads to a displacement of the inner piston 9 to the left hand direction as seen in FIG. 3. Since the pressure connector 25 of the first pressure space 26 is closed during this first phase of the pressure filling of the second pressure space 28, the feeding force of the inner piston 9 is transmitted via the pressure medium present in the first pressure space 26 to the outer piston 7 so that this piston is displaced in the same direction in coordination with the displacement of the inner piston 9; with continuing movement of the two pistons 7, 9, the jaws 31 are pushed into position on the outer surface of the pipe 2 and place the pipe in compression, whereby the outer piston 7 pushes outwardly in a discharging manner the pressure medium present in the third pressure space 51. Once the pipe 2 is placed in compression, the outer piston 7 can no longer be further moved and, in this manner, the pressure rises in the pressure medium in the first pressure space 26 until an overpressure corresponding to the desired compression force is reached. Upon reaching the overpressure, the pressure connector 25 is opened so that the pressure medium in the first pressure space 26 can flow out of the pressure space. In this manner, a continuation of the feed movement of the inner piston 9 is made possible, with the piston now being further displaced relative to the fixedly positioned outer piston 7 and thereby performing a compression working until the space between the annular surfaces of the inner pistons 9 and the outer piston 7, which has been laid out as a function of the compression work to be exerted, has been exhausted.

Figure 5:
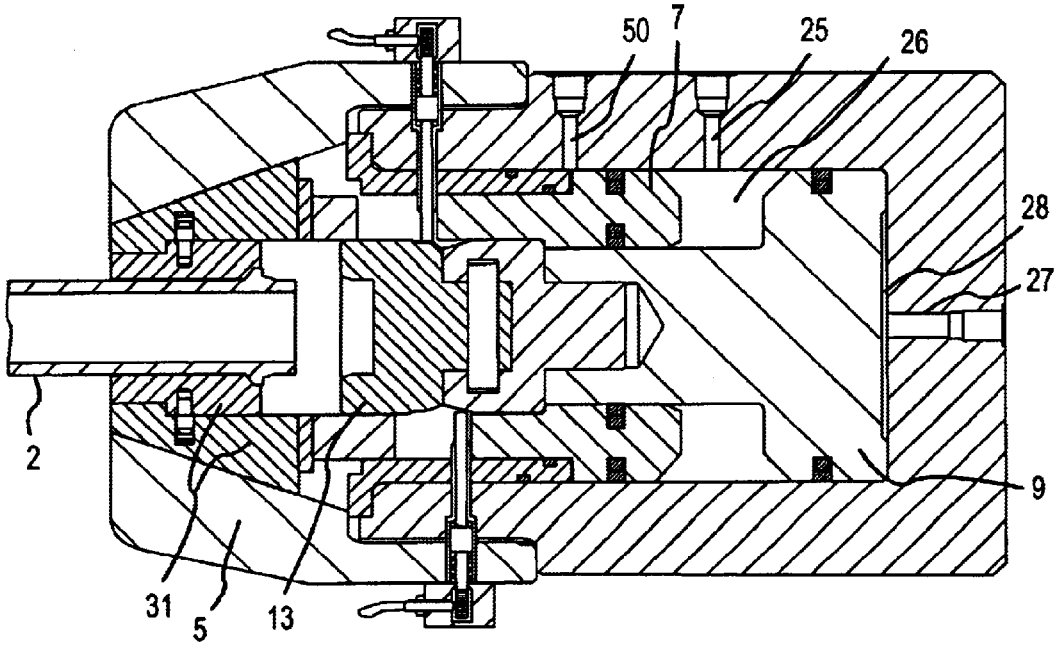

Upon the completion of the compression working, the pressure connector 27 of the second pressure space 25 is moved into a release position and a pressure medium is introduced via the first pressure connector 25 into the first pressure space 26; in this manner, the inner piston 9 is moved in the right hand direction into its start position, as can been seen in FIG. 5. Thereafter, a pressure medium is introduced via the third pressure connector 50 into the third pressure space 51 and, thereby, the outer piston 7 is likewise moved in the right hand direction into its start position as can be seen in FIG. 1, or respectively, in FIG. 2. The end position of the outer piston 7 is thereby determined or given by a stop member (not shown) between the outer piston 7 and the housing.

With respect to the embodiment of the shape-forming device shown in FIGS. 6–10, there is performed, in addition to the functions performed by the embodiment described in accordance with FIGS. 1–5, an additional function by which the shape-form length L required for the working of the workpiece is variably adjustable in a first functional step. Otherwise, the same components are designated with the same reference numerals.

Thus, a receiving space 18 extends outwardly from the rotation preventing device 15 in the axial direction of the piston rod 11 toward the interior thereof, a compression spring 17 being received in the receiving space. The compression spring presses the compression tool 13 into a position in which a gap is created between the compression tool 13 and a surface 14 formed on the back end of the piston rod 11. Correspondingly, a gap is also formed in the region of the rotation preventing device 15 between the compression tool 13 and the piston rod 11 which permits movement of the compression tool 13 against the piston rod 11 by the width of the gap.

In addition to the seals 21 disposed between the respective moveable components, guide rings 19 are provided for guiding the movement of the pistons 7, 9.

Moreover, a sensor arrangement is variably configured in the embodiment shown in FIGS. 6–10. In this connection, the jaws 31 include a measurement groove 35 which extends radially inwardly from the outer surface of the jaws 31. In lieu of the measurement groove 35, a measurement indentation can be provided which, unlike the groove shown in FIGS. 6–9, does not extend in the circumferential direction around the jaws 31 but is, however, only a single indentation formed in one location or at several locations on the jaws. In this event, the proper positioning must be observed relative to a distance sensor, whose function is described in more detail hereinafter.

The jaws 31 further include a measurement opening 29 extending in the radial direction which permits an electromagnet emission such as, in particular, a laser emission, to be directed from outside the jaws 31 interiorly onto a workpiece which is held in compression by the shape-forming device. The measurement opening 29 terminates on the inside of the shape-forming recess 33 so that, as will be described in more detail hereinafter, the progress of the shape-forming process can be measured.

In a variation of the embodiment shown in FIGS. 1–5, the conical surface 6 is configured on the free end of the outer piston 7 turned toward the jaws 31, whereby the conical surface 6 defines the outer periphery of the outer piston 7.

Figure 6:
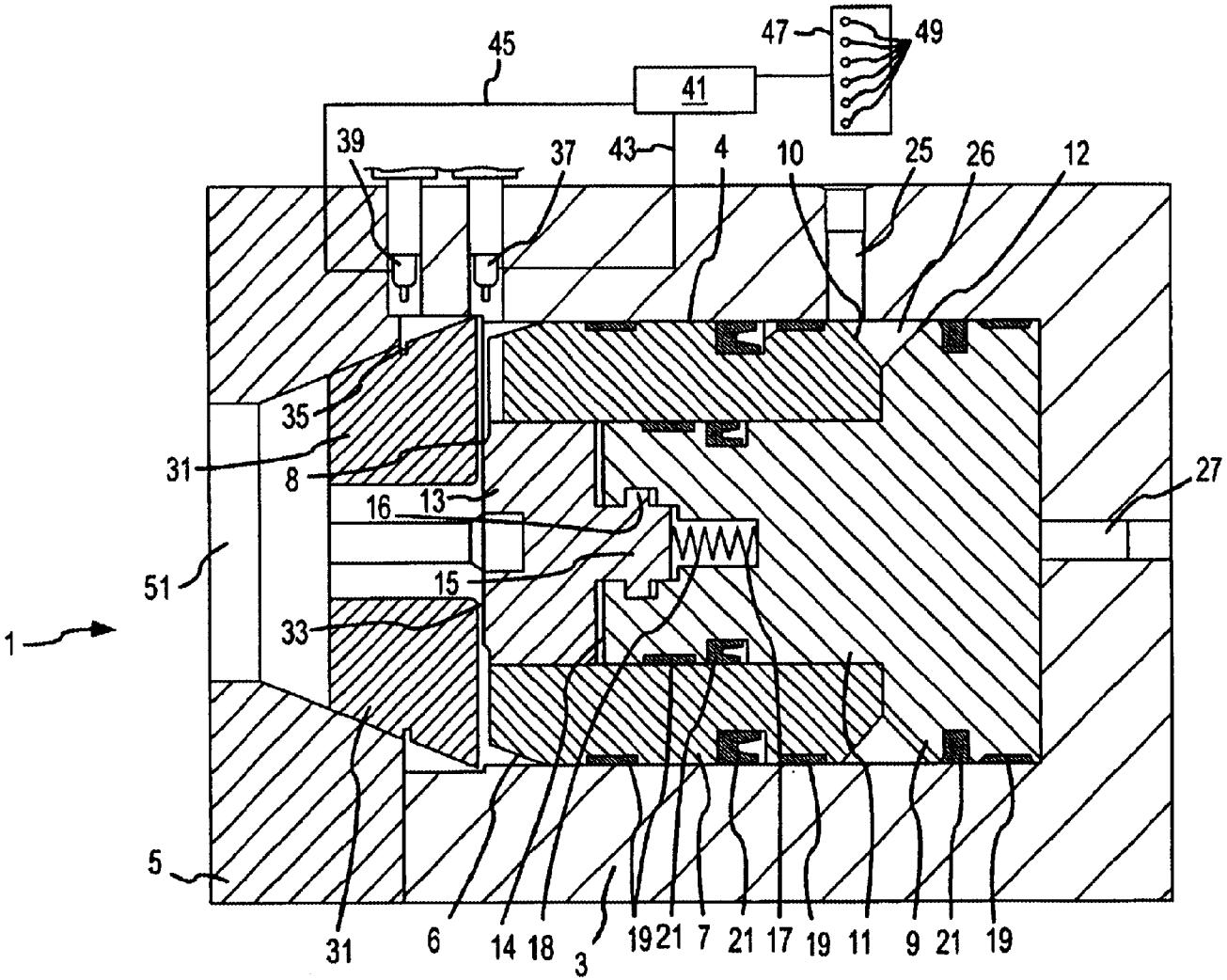

In addition to the bores previously described with respect to the embodiment in FIGS. 1–5 for receipt of the sensors, both bores in the embodiment shown in FIGS. 6–10 each comprise a distance sensor 37, 39. The distance sensors 37, 39 measure the distance to the most closely adjacent object lying in the radial direction inwardly or, respectively, the distance to the oversurface associated therewith. As schematically shown in FIG. 6, the first distance sensor is connected via a first signal lead 43 with a control 41. Furthermore, the second distance sensor 39 is connected via a second signal lead 45 with the control 41. The control 41 is, in turn, connected with a display device 47 which comprises six light emitting diodes 49. The light emitting diodes 49 serve to display the operational phases and the measured operational conditions of the shape-forming device 1.

By use of the device shown in FIGS. 6–10, the device measures the first distance via the first distance sensor 37 to the measurement band 8 of the compression tool 13. The outer diameter at the measurement band 8 is a characteristic measure of the type of compression tool that the compression tool 13 is, especially with respect to its other measurements. Each compression tool connectable with the piston rod 11 or any other tool has, in any event, a measurement band which, however, has a different outer diameter. In accordance with the distance to the measurement band 8 and, correspondingly, the outer diameter of the compression tool 13, the first distance sensor generates a measurement signal which is transmitted to the control 41. The control 41 which is, in particular, configured as an intelligent microprocessor-configured control, recognizes the presence of the tool via the measurement signal.

The second distance sensor 39 measures the distance to the bottom of the measurement groove 35 in the jaws 31. The distance to the groove bottom is a representative measure of the type of jaws which the jaws 31 are. The second distance sensor 39 generates a corresponding measurement signal via the second signal lead 45 to the control 41. The control 41 recognizes the jaws 31.

The jaws 31 and the compression tool 13 serve to shape-form a certain type of pipe—namely, the shape-forming of pipes with a predetermined outer diameter. From the information concerning which compression tool and which jaws are available, the control 41 determines what type of pipes can be shape-formed in combination with the workpieces.

Figure 7:
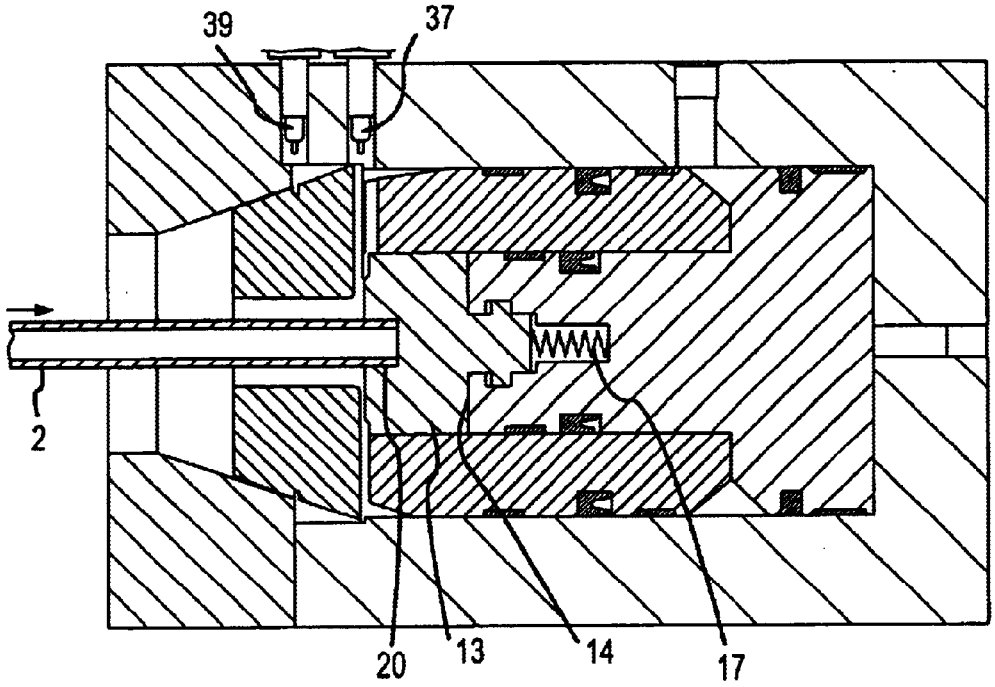

As shown in FIG. 7, if a pipe is received in a receiving opening 20 of the compression tool 13 and, as shown by the arrow pointing to the right, is impacted by a force, the shape-forming of the pipe 2 commences. If the force is sufficiently large in order to move the compression tool 13 so as to overcome the counter force of the spring 17 against the rod rear surface 14, then the compression tool 13 is positioned at a spacing from the jaws 31. As a result of this, the first distance sensor 37 can now measure the distance or spacing to the outer surface of the pipe 2. The first distance sensor 37 transmits via the first signal lead 43 a corresponding measurement signal to the control 41. The control 41 monitors whether the pipe 2 has the proper outer diameter or, respectively, whether the proper measurement signal was received. If this is the case, the control 41 starts the compression-and shape-forming process.

Figure 8:
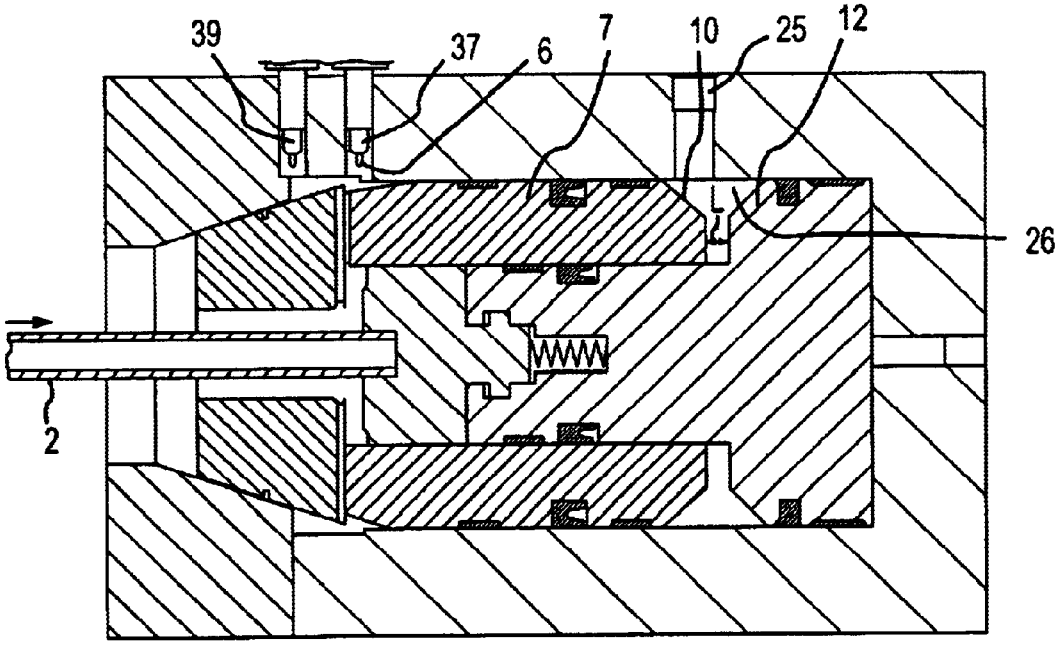

In this connection, as can be seen in FIG. 8, the outer piston 7 is initially moved along the shape-form length L in the axial direction (in the illustration in FIG. 8, towards the left). In order to ensure that the movement is accomplished, a hydraulic medium is introduced through the first pressure connector 25 into the first pressure space 26. During this procedure, the first distance sensor 37 measures the distance to the conical surface 6 of the outer piston 7 and continuously transmits a measurement signal to the control 41. Once the distance between the annularly-shaped surfaces of the first actuation surface 10 and the second actuation surface 12 is the same as the shape-form length L, and the first distance sensor 37 has transmitted a corresponding measurement signal to the control 41, the control 41 interrupts the introduction of the hydraulic medium into the first pressure space 26 so that the movement of the outer piston 7 is stopped.

Figure 9:
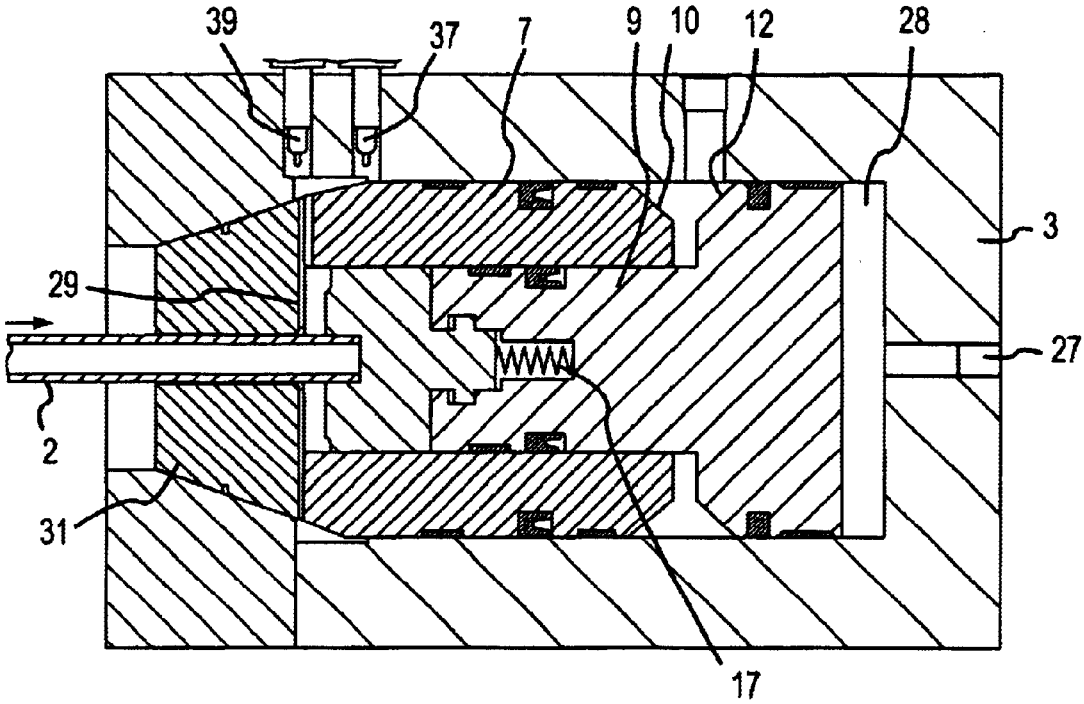
Figure 10:
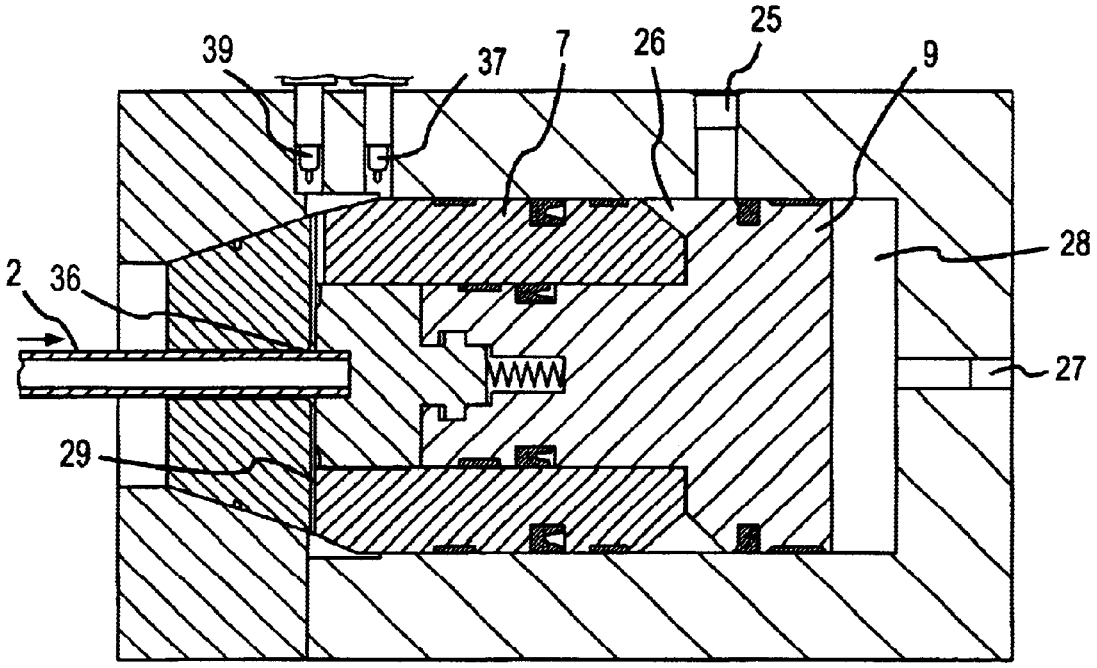

Thereafter, as best seen in FIGS. 9 and 10, the actual compression and shape-forming of the pipe 2 begins, as has been basically described with respect to the embodiment shown in FIGS. 1–5, whereby the control 41 commences the introduction of a hydraulic medium through the second pressure connector 27 into the second pressure space 28. Following this operational condition, which is shown in FIG. 9, the compression-and shape-forming work is completed as has already been described with respect to the embodiment shown in FIGS. 1–5.

Insofar as the compression work of the jaws 31 is effected in a rapid manner, the continuing movement of the inner piston 9 in the axial direction towards the left ensures that no slippage of the pipe 2 through the jaws 31 occurs, once the inner piston 9 has reached its maximal extended position. If, for example, because of relatively low surface roughness of the pipe outer surface and/or the jaws 31, a slippage of this type should occur, an adjustment of the distance between the actuation surfaces 10, 12 (see the operational phase shown in FIG. 8) can be implemented. In this event, the shape-form length L does not, in fact, exactly correspond to the actual path, in which the end of the pipe 2 is shape-formed in the axial direction. A precise pre-adjustment of the desired shape-form path is, however, possible. A further factor, which can lead to inequality between the shape-form length L and the actual shape-form path, is the yieldability or, respectively, the elasticity, of the material connection between the outer piston 7 and the jaws 31. In particular, elastic material can be deployed such as, for example, a material to effect a damping of noise or to prevent a wearing away.

As the end region of the pipe 2 is shape-formed via the application of force by the shape-form tool 13 in the axial direction, the second distance sensor 39 measures, through the measurement opening 29, the distance to the bend or bulge 36 formed as a result of the shape-forming around the outer periphery of the pipe 2. A corresponding signal is continuously provided by the second distance sensor via the second signal lead 45 to the control 41. After the shape-forming of the pipe has ended by means of engagement of the shape-form tool 13 against the jaws 31, the actual measurement value is compared with a desired value and it is determined whether the bulge 36 has achieved the desired outer diameter. Alternatively, the shape-forming can be ended once the control 41 determines that the bulge 36 has achieved the desired outer diameter and the control can thereby interrupt the shape-forming process. In this event, the shape-form length L serves to ensure that a sufficiently long shape-forming path is available.

After the stroke movement of the inner piston 9 in the axial direction to the left has ended, the second pressure space 28 is released from its pressurized condition—that is, the hydraulic medium disposed therein is permitted to flow out through the second pressure connector 27. Moreover, the pressure medium in the first pressure space 26 is flowed out via the first pressure connector 25. In this manner, the inner piston 9 is moved under the influence of the pressure medium in the second pressure space 25 in the axial direction toward the right. Thereafter, via opening of the blocking valve, the hydraulic medium in the first pressure space 26 is released so that the hydraulic medium flows out of the pressure space 26. The outer piston 7 is returned to its start position by means of spring force generated thereagainst by one or more not-illustrated springs to return to its start position as shown in FIG. 6. In this manner, the jaws 31 release the shape-formed pipe 2 so that this pipe can be removed.

Once the heretofore described work steps, operational conditions and/or operational phases have been successfully concluded, the respective status is indicated by illumination of a respective one of the light emitting diodes 49. In this connection, the control 41 controls the display device 47. The meaning of the illumination of the in total six light emitting diodes 49 is, in connection with the serial passage of a successfully concluded shape-forming process, as follows:

1. Light Emitting Diode: Compressive- and shape-forming tool correctly disposed, 2. Light Emitting Diode: Pipe outer diameter is appropriate for the shape-forming tool,
3. Light Emitting Diode: Forward movement of the outer piston and setting of the shape-forming length L concluded,
4. Light Emitting Diode: Pipe set in compression,
5. Light Emitting Diode: Pipe is shape-formed, shape-forming result is satisfactory,
6. Light Emitting Diode: Return stroke is concluded, pipe can be removed.

If a mistake occurs, this can be determined by reading the display device 47, which indicates the respective operational phase or, respectively, operational condition, during which the mistake occurred. In particular, an additional, not-illustrated light emitting diode can be provided which displays or illuminates if there is an interruption of the shape-forming process. Alternatively or additionally, a mistake can be indicated by intermittent lighting of a light emitting diode to show the corresponding operational phase. Also, it can be additionally interpreted that, if, for example, a light emitting diode does not illuminate, yet a light emitting diode later in the series does illuminate, that a mistake has occurred.

The specification incorporates by reference the disclosure of German priority documents DE 100 40 596.7 filed Aug. 16, 2000, DE 100 40 595.9 filed Aug. 16, 2000 and PCT/DE01/03117 filed Aug. 11, 2001.

The present invention is, of course, in no way restricted to the specific disclosure of the specification and drawings, but also encompasses any modifications within the scope of the appended claims.

What is claimed is:

1. A shape-forming device for shape-forming the end region of a workpiece, comprising:

a housing having one end in which a workpiece which is to be shape-formed can be received;

a plurality of jaws disposed in the housing, the jaws being operable to exert a compressive retaining force on a workpiece received in the housing such that the workpiece is releasably retained in a fixed position relative to the housing while shape-forming work is performed on the workpiece;

a first hydrodynamically actuable force transmission element operable to place the workpiece in compression;

a compression surface disposed axially intermediate the one end of the housing and the first force transmitting element and movable in a shape-form working axial direction toward the one end of the housing to engage a workpiece retained by the jaws in the housing;

a second hydrodynamically actuable force transmission element, the first force transmitting element and the second force transmitting element being disposed in the housing with the first force transmitting element intermediate the one end of the housing and the second force transmitting element, the first force transmitting element having a bore through which the second force transmitting element extends such that the second force transmitting element is axially displaceable relative to the first force transmitting element and the compression surface being movably guided by the first force transmitting element and engageable by the second force transmitting element such that the second force transmitting element applies a force on the compression surface to move the compression surface in the shape-form working direction, the first force transmitting element and the second force transmitting element being movable in the shape-form working axial direction from respective start positions toward the one end of the housing and in an opposite axial direction along which the first force transmitting element and the second force transmitting element move to return to their respective start positions;

a first pressure space formed between the first force transmitting element and the second force transmitting element, the first pressure space being communicated via a first pressure connector with a pressure medium source; and a second pressure space communicated via a second pressure connector with a pressure medium source, the second pressure space being disposed relative to the second force transmitting element such that the introduction of a pressure medium into the second pressure space effects axial movement of the second force transmitting element in the shape-form working axial direction, the shape-forming device being operable to force the compression surface against the retained workpiece in a shape-form working manner such that the workpiece is shape-formed via an operation in which a pressure medium is introduced into the second pressure space to effect movement of the second force transmitting element along the shape-form working axial direction at the same time that a pressure medium in the first pressure space is maintained such that an axial propulsion force generated by the axial movement of the second force transmitting element is transmitted to the first force transmitting element in a manner which effects corresponding movement of the first force transmitting element in the shape-form working axial direction, whereupon the compression surface eventually engages a retained workpiece as the axial movement of the first force transmitting element continues and, following engagement of the compression surface with the retained workpiece, the axial propulsion force on the first force transmitting element is maintained until a desired overpressure develops in the first pressure space and, thereafter, the pressure medium from the first pressure space is released such that continued pressure on the second force transmitting element via the pressure medium in the second pressure space effects movement of the second force transmitting element relative to the first force transmitting element so as to thereby apply force on the compression surface and thus effect shape-forming of the retained workpiece.

2. A shape-forming device according to claim 1 and further comprising a third pressure space having a connection to a third pressure connector provided as the drive for the return movement of the first force transmission element.

3. A shape-forming device according to claim 1 and further comprising a return spring provided as a drive for the return movement of the first force transmission element.

4. A shape-forming device according to claim 1, wherein the start position of the first force transmission element is defined by a stop or shoulder configured between the housing and the first force transmission element.

5. A shape-forming device according to claim 1 and further comprising that before the start of the compression-and/or shape-forming process, it can be automatically determined if a suitable compression-and/or shape-forming tool is available and/or is properly positioned.

6. A shape-forming device according to claim 5, and further comprising a sensor such that at least one of the availability and the proper position of the workpiece can be determined via a non-contact distance measurement.

7. A shape-forming device according to claim 1, and further comprising a sensor for sensing the start position of the shape-forming workpiece, and its position during the shape-forming process as it moves along the work path.

8. A shape-forming device according to claim 1, wherein the first force transmission element is, before the beginning of the compression-and shape-forming process, movable away from the fixedly positioned second force transmission element via introduction of a pressure medium into the first pressure space to effect variable adjustment of a working path provided for the shape-forming of the workpiece.

9. A shape-forming device according to claim 8, wherein the length of the first pressure space is adjustable between the first actuation surface and the second actuation surface before the shape-forming of the workpiece in order to set a defined work path.

10. A shape-forming device according to claim 9, wherein the length of the first pressure space is measurable in a selected one of a direct measurement manner and an indirect measurement manner in order to adjustably set the length thereof at a desired value.

11. A shape-forming device according to claim 9, wherein the length is indirectly measurable via a distance sensor, which is oriented toward a surface, whose distance from the distance sensor varies as a function of the length of the pressure space.

12. A shape-forming device according to claim 8, wherein the shape-forming device is operable to perform non-contact measurement to determine whether the workpiece to be shape-formed is in a start position, has been placed in compression, or has already been subjected to the start of the shape-forming, and to generate a signal as a function of the measurement result.

13. A shape-forming device according to claim 1, wherein a distance to the workpiece to be shape-formed is measurable via a non-contact measurement.

14. A shape-forming device according to claim 5, wherein at least one of the availability and the proper position of the compression tool is determinable via the same senor which also measures a start position of the workpiece and the measurement of the position can be cleared once the workpiece has been brought into the start position.

15. A shape-forming device according to claim 1, and further comprising means for effecting return movement of the first force transmission element in correspondence with return movement of the second force transmitting element along a portion of the movement of the second force transmitting element to its start position.

* * * * *

UNITED STATES PATENT AND TRADEMARK OFFICE

CERTIFICATE OF CORRECTION

PATENT NO. : 6,708,548 B1
DATED : March 23, 2004
INVENTOR(S) : Ehrke et al.

It is certified that error appears in the above-identified patent and that said Letters Patent is hereby corrected as shown below:

Title page,
Item [54], should read as follows:
-- [54] Title: DEVICE FOR SHAPE-FORMING AN END REGION OF A WORKPIECE --

Signed and Sealed this

First Day of June, 2004

JON W. DUDAS
*Acting Director of the United States Patent and Trademark Office*